US005346776A

United States Patent [19]

Taniguchi et al.

[11] Patent Number: 5,346,776

[45] Date of Patent: Sep. 13, 1994

[54] ELECTROLUMINESCENT PANEL

[75] Inventors: Kouji Taniguchi, Shiki; Koichi Tanaka, Nara; Kousuke Terada, Tenri; Akiyoshi Mikami, Yamatotakada; Masaru Yoshida, Ikoma, all of Japan

[73] Assignee: Sharp Kabushiki Kaisha, Japan

[21] Appl. No.: 853,938

[22] Filed: Mar. 19, 1992

Related U.S. Application Data

[60] Division of Ser. No. 759,205, Sep. 11, 1991, Pat. No. 5,156,924, which is a continuation of Ser. No. 455,752, Dec. 22, 1989, abandoned.

[30] Foreign Application Priority Data

Dec. 29, 1988 [JP] Japan ..... 63-331991

[51] Int. Cl.[5] ..... H05B 33/14

[52] U.S. Cl. ..... 428/690; 428/917; 313/506; 313/507; 313/509

[58] Field of Search ..... 313/506, 507, 509; 428/690, 917, 67, 141

[56] References Cited

U.S. PATENT DOCUMENTS 4,727,004 2/1988 Tanaka et al. ..... 428/690
4,877,995 10/1989 Thioulouse et al. ..... 313/507
4,945,009 7/1990 Taguchi et al. ..... 428/690

FOREIGN PATENT DOCUMENTS 63-72098 4/1988 Japan .
64-60993 3/1989 Japan .

OTHER PUBLICATIONS

P. Thioulouse et al., "Thin-film photoconductor-electroluminescent memory device with a high brightness and a wide stable hysteresis," from Appl. Phys. Lett. 50(17), 27 Apr. 1987, pp. 1203-1205.

S. Tanaka et al., "A Full-Color Thin-Film Electroluminescent Device with Two Stacked Substrates and Color Filters," from SID 87 Digest, pp. 234-237.

*Primary Examiner*—Charles R. Nold

*Attorney, Agent, or Firm*—Merchant, Gould, Smith, Edell, Welter & Schmidt

[57] ABSTRACT

A multi-color electroluminescent panel comprising common electrodes and a plurality of transparent electrodes, an EL light emitting layer disposed between the common and transparent electrodes and capable of exhibiting a hysteresis in light emission luminance versus applied voltage characteristic, and band-pass color filters provided on the EL light emitting layer for passing therethrough light of a particular color emitted from the EL light emitting layer.

3 Claims, 7 Drawing Sheets

ELECTROLUMINESCENT PANEL

This is a division of application Ser. No. 07/759,205, filed Sep. 11, 1991, now U.S. Pat. No. 5,156,924 which is a continuation of application Ser. No. 07/455,752, filed Dec. 22, 1989, now abandoned.

BACKGROUND OF THE INVENTION

1. Field of the Invention

The present invention generally relates to an electroluminescent panel and, more particularly, to a multicolor electroluminescent panel having a multi-color display capability.

2. Description of the Prior Art

An electroluminescent panel having a multi-color display capability is well known in the art. Two types of prior art multi-color electroluminescent panels are shown in FIGS. 11 and 12, respectively, of the accompanying drawings in schematic sectional representation. The multi-color electroluminescent panel shown in FIG. 11 is of a type comprising a plurality of electrodes 67, a plurality of common electrodes 62 formed on a substrate 61, two insulating layers 64 and 66 disposed between the electrodes 67 and the common electrodes 62 and a periodic structure of light emitting layers 65*a*, 65*b* and 65*c* disposed cyclically between the insulating layers 64 and 66 capable of emitting respective light of different colors.

The prior art multi-color electroluminescent panel shown in FIG. 12 is of a type comprising a plurality of electrodes 77, a plurality of common electrodes 72 formed on a substrate 71, two insulating layers 74 and 76 disposed between the electrodes 77 and the common electrodes 72, a single light emitting layer 75 disposed between the insulating layers 74 and 76 and a periodic structure of different color filters 78*a*, 78*b* and 78*c* arranged cyclically on the substrate 71 on one surface thereof opposite to the common electrodes 72.

In both of the prior art multi-color electroluminescent panels, any one of the light emitting layers 65*a*, 65*b* and 65*c* and the light emitting layer 75 is of a type having the light emission luminance versus applied voltage characteristic (characteristic of the light emission luminance relative to the applied voltage) which does not exhibit a hysteresis.

Specifically, the multi-color electroluminescent panel of the construction shown in FIG. 11 has a problem in that, since the color of light emitted from each of the light emitting layers is peculiar to material used to form the respective light emitting layer, the color cannot be selected as desired. Also, since the element has no hysteresis as described above, the prior art multi-color electroluminescent panel cannot be used in such an application that, when the panel comprising of picture elements with hysteresis is driven by the line sequential scanning method, the frequency of sustaining voltage pulses which are continuously applied to all picture elements of the panel can be, for example, about ten times the frame frequency at which write-in (light-on) pulses and erasing (light-off) pulses are applied, thereby to increase the number of lighting to increase the light emission luminance by a factor of 10. This application was reported in Digest 1976 SIP (Society for Information Display) Int. Symp. p.52. Accordingly, the prior art multi-color electroluminescent panel of the construction shown in FIG. 11 cannot be used in an environment where a high light emission luminance is desired.

On the other hand, the prior art multi-color electroluminescent panel of the construction shown in FIG. 12 cannot also be used in the way as described in connection with the electroluminescent panel of FIG. 11 because it does not exhibit a hysteresis. In addition, because of a loss of filter, the amount of light emitted to tile outside tends to be low, failing to provide a luminance of practically acceptable level.

SUMMARY OF THE INVENTION

Accordingly, the present invention has an essential object to provide an improved multi-color electroluminescent panel of a type wherein the color of light can be selected as desired and can provide a relatively high luminance of practically acceptable level.

To this end, the present invention provides a multicolor electroluminescent panel comprising first and second electrode means, an electroluminescent (EL) light emitting layer means disposed between tile first and second electrode means and capable of exhibiting a hysteresis in light emission luminance versus applied voltage characteristic, and a band-pass color filter means provided on the EL light emitting element means for passing therethrough light of a particular color emitted from the EL light emitting layer means.

Preferably, the EL light layer means is a light emitting layer capable of emitting white light. Also, the multi-color EL panel according to the present invention is preferably provided with a photo-conductive layer means disposed between the first and second electrodes.

Also, it is preferred that a portion of the light emitting layer means between picture elements formed by the first and second electrode means is depleted or removed.

With the multi-color EL panel so constructed as hereinabove described in accordance with the present invention, the above described element can exhibit a hysteresis in light emission luminance versus applied voltage characteristic and, therefore, the luminance of light emitted from the element can be increased advantageously. When the panel with scanning electrodes of 400 lines is driven by the line sequential scanning method using voltage pulses with pulse width of 40 secs., the maximum frame frequency is about 60 Hz. In the case that the luminance versus applied voltage characteristic have a hysteresis, while pulses of sustaining voltage, For example, with a frequency of 600 Hz is continuously applied to all picture elements in the panel, on- or off-state (on: emitting state, off: no emitting state) of each element is controlled by writing or erasing pulse with the frame frequency. The luminance of on-state element is proportional to the frequency of the sustaining voltage pulse. On the other hand, in the case without hysteresis, the luminance of on-state element is the value proportional to the frame frequency. Therefore, the higher luminance can be obtained by a factor of 10, using a hysteresis.

Also, where the light emitting layer means capable of emitting the light of white color is employed, any desired color can be selected by selecting the band of the transmissive filter means.

Where the photo-conductive layer means is employed, the combined use of the light emitting layer means and the photo-conductive layer means renders the EL panel to exhibit the additional hysteresis (as discussed in IEEE Trans Electron Device ED-33,1149, 1986) and, therefore, the light emission luminance can be increased.

In the EL panel wherein the photo-conductive layer means is employed between the first and second electrode means and, also, that portion of the EL layer means between the picture elements which are formed by the first and second electrode means is depleted, light from any one of the picture elements being electrically energized to emit light will not propagate within the light emitting layer means having a high refractive index which would otherwise result in failure of light to propagate therethrough. Accordingly, the photoconductive layer will not exhibit a low resistance in the vicinity of the picture element when electrically energized to emit light and there is no possibility that any other picture element which should not emit light may emit light under the influence of the picture element when energized to emit light.

BRIEF DESCRIPTION OF THE DRAWINGS

This and other objects and features of the present invention will become clear from the following description of the present invention taken in conjunction with preferred embodiments thereof with reference to the accompanying drawings, in which:

FIG. 2(*b*) is a graph showing respective light transmissivities of filters employed in the multi-color EL panel shown in FIG. 1;

FIG. 2(*c*) is a graph showing a spectrum of light emitted from the multi-color EL panel shown in FIG. 1;

FIG. 5(*b*) is a graph showing respective light transmissivities of filters employed in the multi-color EL panel shown in FIG. 4;

FIG. 5(*c*) is a graph showing a spectrum of light emitted from the multi-color EL panel shown in FIG. 4;

DETAILED DESCRIPTION OF THE EMBODIMENT

Figure 1:
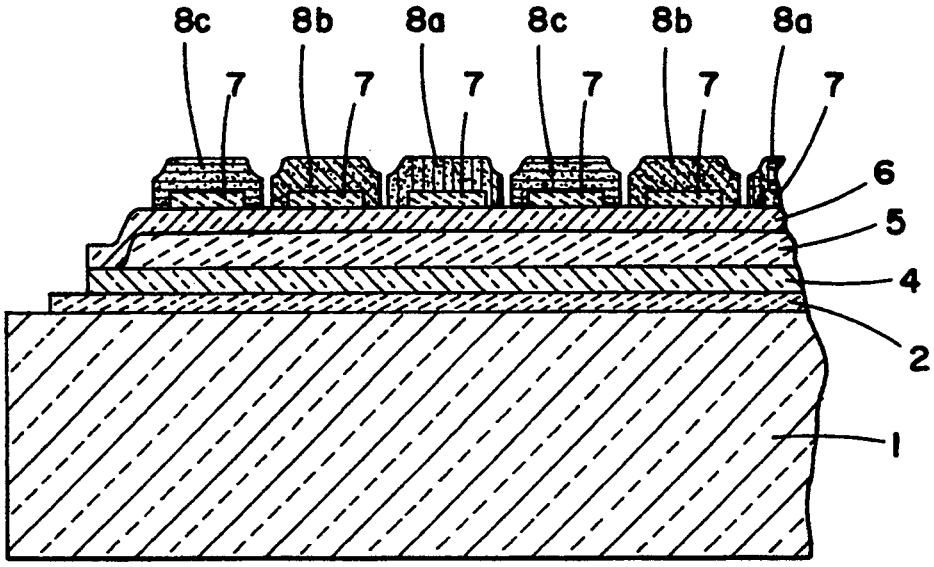
FIG. 1 is a schematic sectional view of a multi-color EL panel according to a first preferred embodiment of the present invention.

Referring first to FIG. 1 showing a multi-color EL panel according to a first preferred embodiment of the present invention, the panel shown therein comprises a glass substrate 1 having one surface thereof having a plurality of common electrodes 2, a first insulating layer 4, a light emitting layer 5, a second insulating layer 6 and a plurality of transparent electrodes 7 deposited thereon in this specified order in a direction outwardly therefrom. The common electrodes 2 and any one of the transparent electrodes 7 are in the form of an ITO film (a film made of indium oxide added with tin). The first insulating layer 4 is a double-layered structure comprised of an $SiO_2$ film and an $Si_3N_4$ film whereas the second insulating layer 6 is a double-layered structure comprised of an $Si_3N_4$ film and an $SiO_2$ film. The light emitting layer 5 is a double-layered structure comprised of an SrS:Ce film and a CaS:Eu film.

The layers 2, 4, 5, 6 and 7 are 1,500 angstroms, 2,500 angstroms, 15,000 angstroms, 2,000 angstroms and 1,500 angstroms in thickness, respectively, and the light emitting layer 5 is formed by the use of any known electron beam vapor deposition technique or any known sputtering technique.

The multi-color EL panel shown in FIG. 1 also comprises a periodic structure of different color filters 8*a*, 8*b* and 8*c* formed cyclically over the associated transparent electrodes 7 by the use of any known color filter forming technique such as, for example, an electro-deposition technique or a dyeing technique.

Figure 2A:
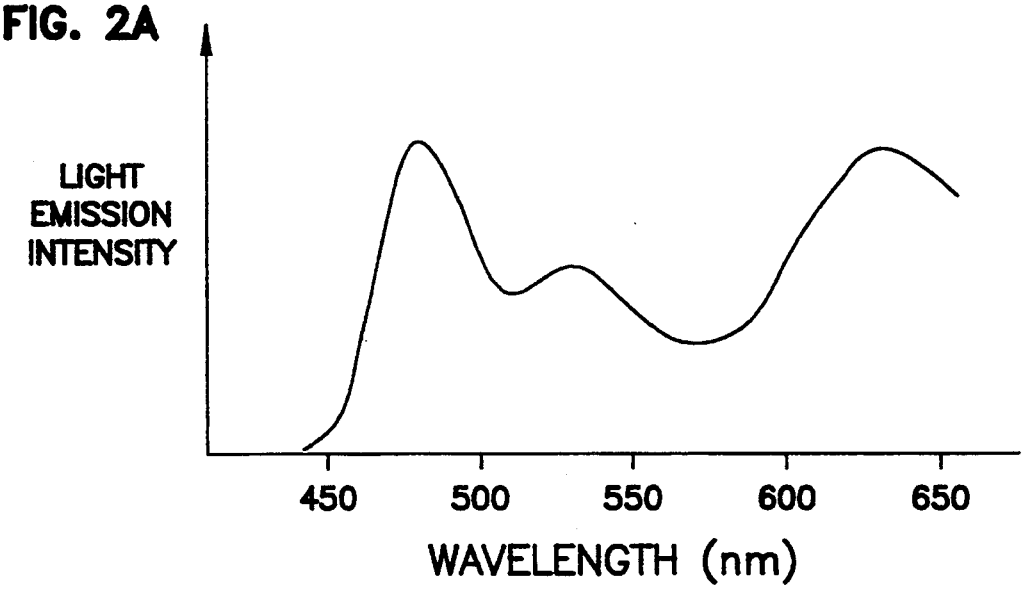
FIG. 2(*a*) is a graph showing a spectrum of light emitted from a multi-color EL panel similar to that shown in FIG. 1, but having no filter employed.
Figure 2B:
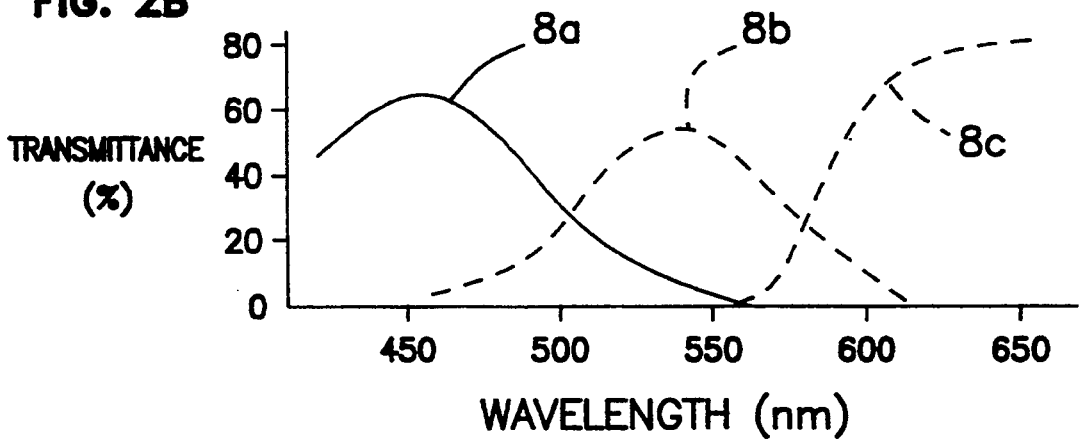
Figure 2C:
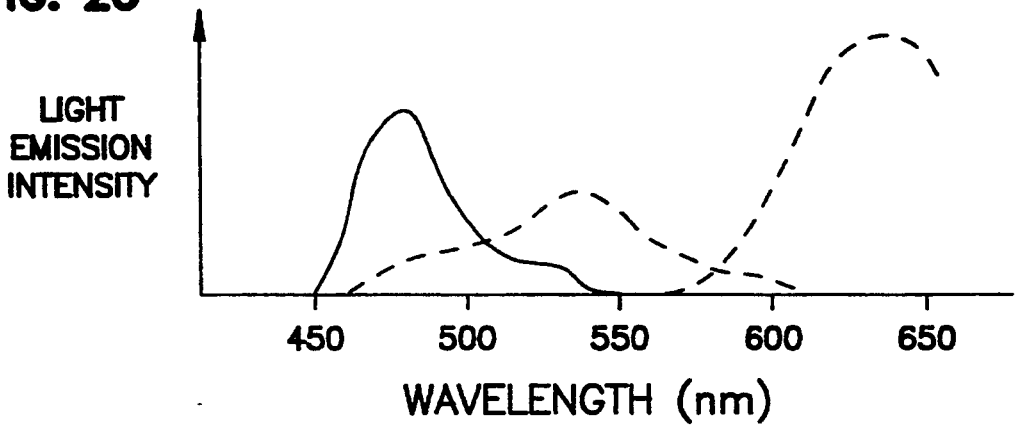
Figure 3:
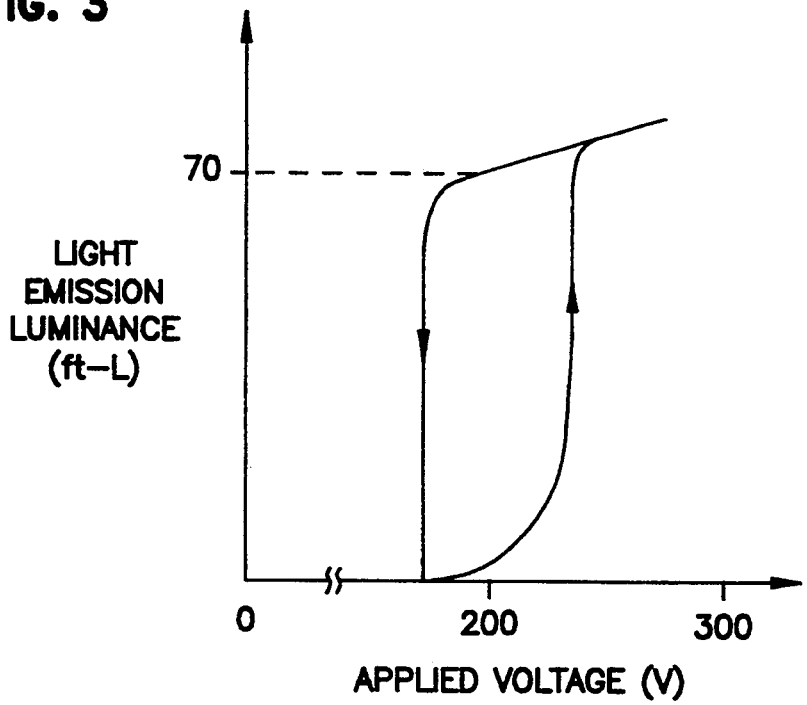
FIG. 3 is a graph showing a light emission luminance versus applied voltage characteristic of the multi-color EL panel shown in FIG. 1.

FIG. 2(*a*) is a graph showing a spectrum of light emitted from the multi-color EL panel wherein no filter has yet been formed subsequent to the formation of the transparent electrodes 7; FIG. 2(*b*) is a graph showing light transmissivities of the filters 8*a*, 8*b* and 8*c* employed in the multi-color EL panel shown in FIG. 1; and FIG. 2(*c*) is a graph showing a spectrum of light emitted from the multi-color EL panel having the filters 8*a*, 8*b* and 8*c* formed over the transparent electrodes 7. From FIG. 2(*c*), it is clear that the multi-color EL panel shown in FIG. 1 is capable of effecting displays in blue, green and red colors. Also, as shown in FIG. 3, the multi-color EL panel of FIG. 1 has a light emission luminance versus applied voltage characteristic which exhibits a hysteresis, whereas the light emission luminance of the multi-color IEL panel having no filter shows about 70 ft-L when driven at 500 Hz. Because of the presence of hysteresis as discussed above and as shown in FIG. 3, each picture element can provide a luminance generally equal that provided when driven at 500 Hz. without being limited by the number of scanning lines, even in the application wherein the multi-color EL panel is driven according to the line sequential scanning system. Thus, both of a reduction in amount of light emitted to the outside as a result of a filtering loss and a reduction in substantial area of light emitting surface for each color as compared with that in a monochromatic display can be advantageously compensated for. Therefore, the multi-color EL panel according to the present invention can provide a high luminance of practically acceptable level.

Figure 4:
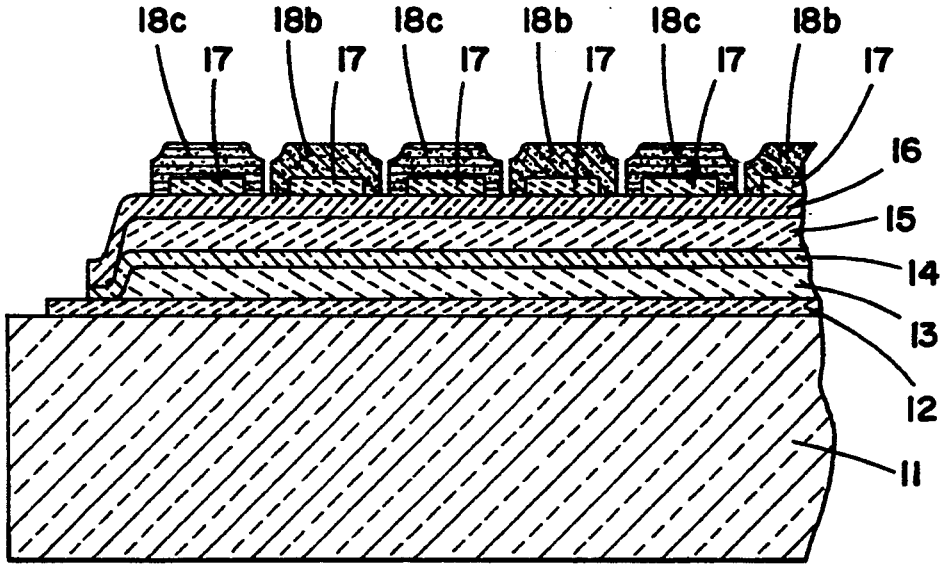
FIG. 4 is a view similar to FIG. 1, showing a second preferred embodiment of the present invention.

FIG. 4 illustrates the multi-color EL panel according to a second preferred embodiment of the present invention. The EL panel shown therein comprises a glass substrate 11 having one surface thereof having a plurality of common electrodes 12, a photo-conductive layer 13, a first insulating layer 14, a light emitting layer 15, a second insulating layer 16 and a plurality of transparent electrodes 17 deposited thereon in this specified order in a direction outwardly therefrom. Each of the common electrodes 12 is in the form of a double-layered structure comprised of an ITO film and an $SnO_2$ film whereas each of the transparent electrodes 17 is in the form of an ITO film. The photo-conductive layer 13 is in the form of an $Si_xC_{1-x}$ ($0<X<1$), the first insulating layer 14 is in the form of an $Si_3N_4$ film, and the second insulating layer 16 is a double-layered structure comprised of an $Si_3N_4$ film and an SiO film. The light emitting layer 15 is a double-layered structure comprised of a ZnS:Mn film and a ZnS:Tb,F film.

The $Si_xC_{1-x}$ film referred to above is formed by the use of a sputtering technique wherein Si is used as a target and $C_3H_8$ is used as a sputtering gas, and is hydrogenated for the purpose of enhancing the photo-conductivity. Also, since a direct contact between the $Si_xC_{1-x}$ film and the ZnS:Mn film may reduce the intensity of light from the EL panel, the $Si_3N_4$ film referred to above and having a film thickness within the range of 100 to 1,000 angstroms is interposed between the $Si_xC_{1-x}$ film and the ZnS:Mn film to avoid such reduction in intensity of light emitted from the EL panel. It is to be noted that the layers 12, 13, 15, 16 and 17 are 1,500 angstroms, 2 micrometers, 7,000 angstroms, 2,500 angstroms and 1,500 angstroms in thickness, respectively.

The multi-color EL panel shown in FIG. 4 also comprises a periodic structure of different color filters **18*b* and 18*c* formed cyclically over the associated transparent electrodes 17** by the use of any known color filter forming technique such as, for example, an electrodeposition technique or a gelatine dyeing technique.

Figure 6:
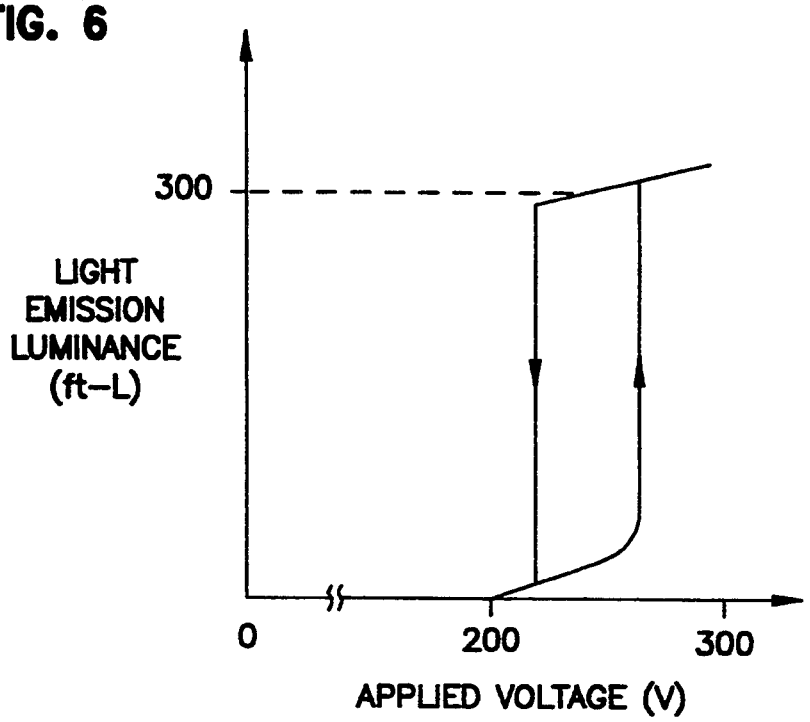
FIG. 6 is a graph showing a light emission luminance versus applied voltage characteristic of the multi-color EL panel shown in FIG. 4.
Figure 5A:
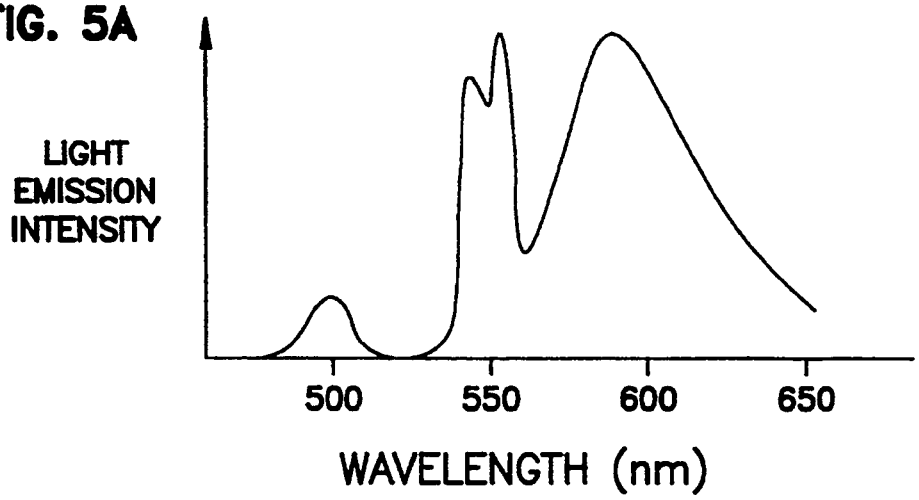
FIG. 5(*a*) is a graph showing a spectrum of light emitted from a multi-color EL panel similar to that shown in FIG. 4, but having no filter employed.
Figure 5B:
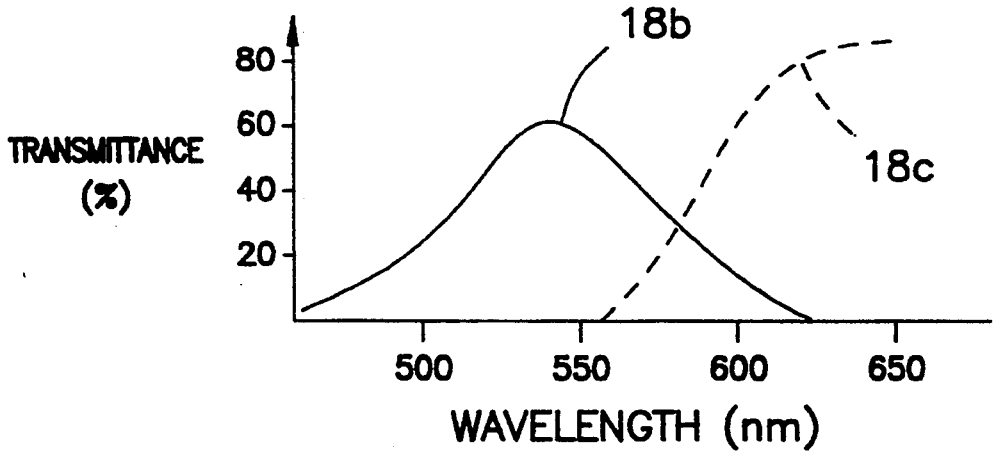
Figure 5C:
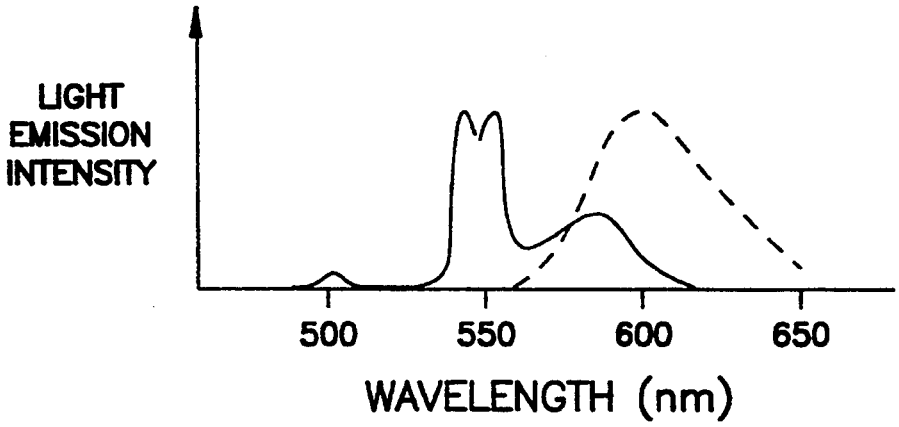

FIG. 5(*a*) is a graph showing a spectrum of light emitted from the multi-color EL panel wherein no filter has yet been formed subsequent to the formation of the transparent electrodes 17; FIG. 5(*b*) is a graph showing light transmissivities of the filters **18*b* and 18*c* employed in the multi-color EL panel shown in FIG. 4; and FIG. 5**(*c*) is a graph showing a spectrum of light emitted from the multi-color EL panel having the filters **18*b* and 18*c* formed over the transparent electrodes 17. From FIG. 5**(*c*), it is clear that: the multi-color EL panel shown in FIG. 4 is capable of effecting displays in green and red colors. Also, as shown in FIG. 6, the multi-color EL panel of FIG. 4 has a light emission luminance versus applied voltage characteristic which exhibits a hysteresis, whereas the light emission luminance of the multi-color EL panel having no filter shows about 300 ft-L when driven at 500 Hz. Because of the presence of the hysteresis as discussed above and as shown in FIG. 6, each picture element can provide a luminance generally equal to that provided when driven at 500 Hz, without being limited by the number of scanning lines, even in the application wherein the multi-color EL panel is driven according to the line sequential scanning system. Thus, both of a reduction in amount of light emitted to the outside as a result of a filtering loss and a reduction in substantial area of light emitting surface for each color as compared with that in a monochromatic display can be advantageously compensated for. Therefore, the multi-color EL panel according to the embodiment shown in and described with reference to FIG. 4 can provide a higher luminance of practically acceptable level.

Figure 7:
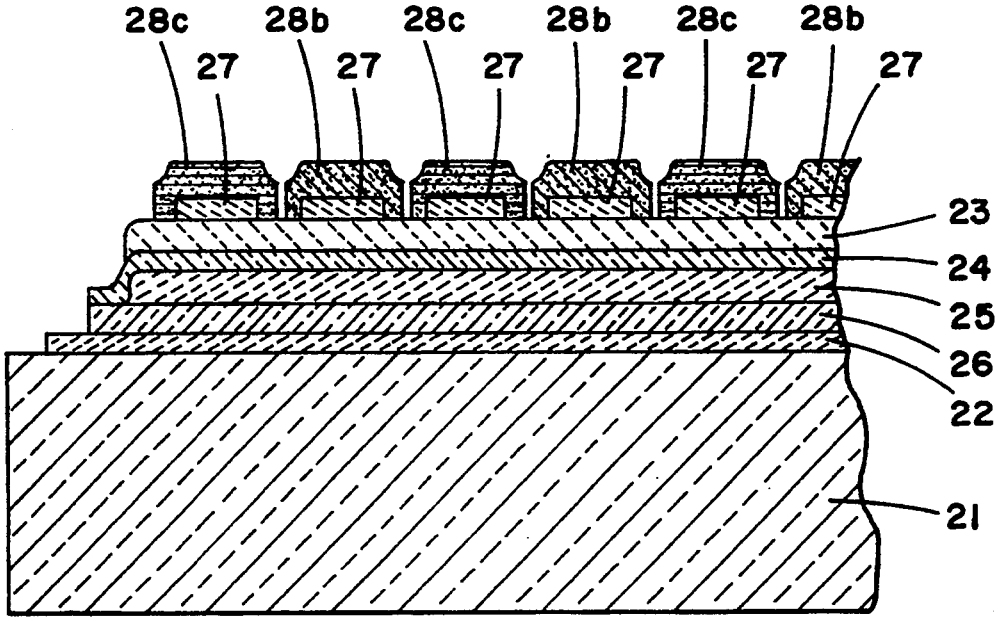
FIGS. 7 to 10 are schematic sectional views showing the multi-color EL panel according to third to sixth preferred embodiments of the present invention, respectively.

It is to be noted that the order of deposition of the layers 13 to 16 situated between the glass substrate 11 and the group of the transparent electrodes 17 in the EL panel of FIG. 4 may be reversed as shown in FIG. 7 showing a third preferred embodiment of the present invention. However, in the third embodiment of the present invention shown in FIG. 7, since light may not be drawn outwards if the photo-conductive layer is opaque, the photo-conductive layer now identified by 24 in FIG. 7 is in the form of a transparent layer which is formed by limiting the composition ratio X in the $Si_xC_{1-x}$ ($0<X<0.5$) to a value within the range of 0 to 0.5. When light is to be drawn through the substrate 21, the composition ratio X may not be limited as a matter of course.

Figure 8:
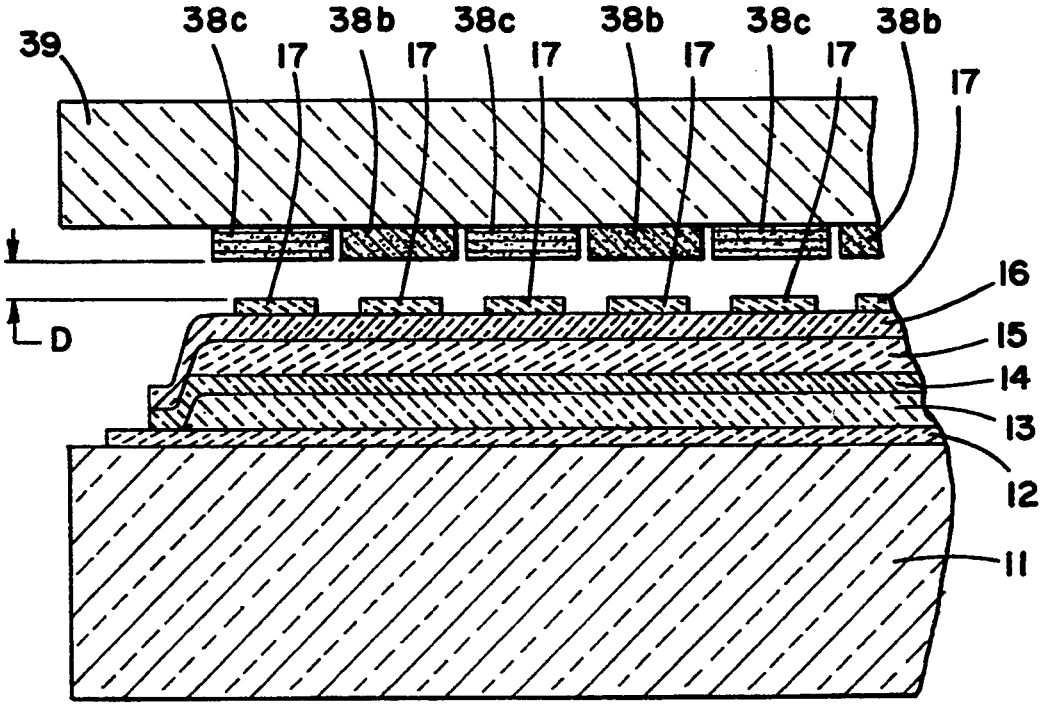
Figure 9:
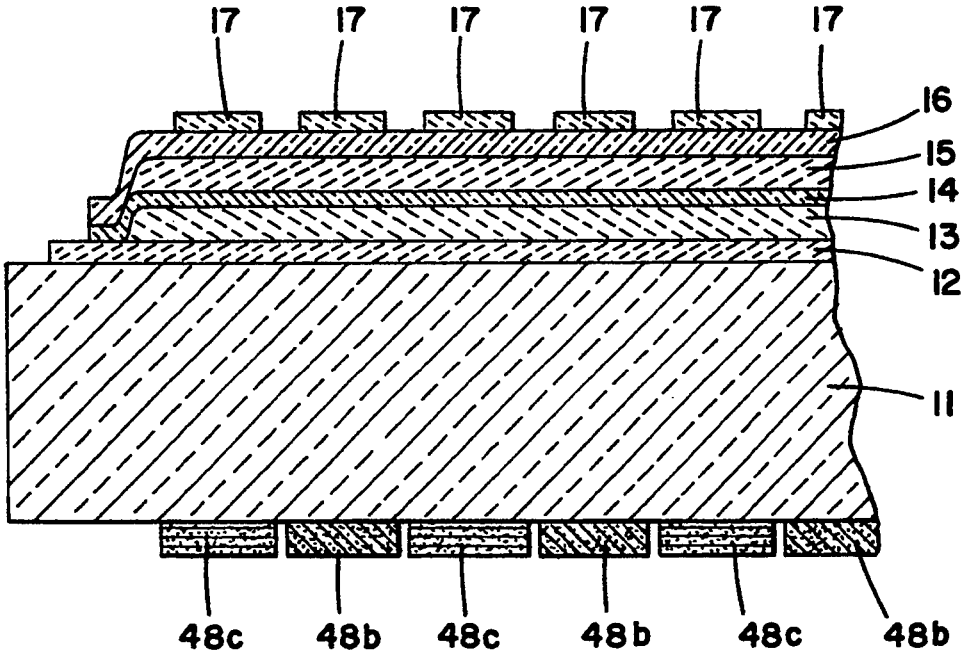

The EL panel according to a fourth preferred embodiment of the present invention shown in FIG. 8 is similar to that shown in and described with reference to FIG. 4 in connection with the second preferred embodiment of the present invention, except that, instead of the formation of the different color filters over the transparent electrodes 17 such as shown in FIG. 4, filters **38*b* and 38*c* corresponding in function and structure to the filters 18*b* and 18*c* of FIG. 4 are formed cyclically on an additional substrate 39 which is in turn disposed above the substrate 11 with the filters 38*b* and 38*c* aligned with the associated transparent electrodes 17 while a predetermined space is provided between an outermost surface of each of the filters 38*b* and 38*c* and an outermost surface of each of the transparent electrodes 17 as indicated by D in FIG. 8. The space D is preferably so selected that no deviation between the picture element at each of the transparent electrodes 17 and the associated filter 38*b* or 38*c* will occur with the angle of sight of a viewer. In this construction of FIG. 8, even though one or more localized defects occur as a result of a dielectric breakdown occurring in the EL panel, no filter will be adversely affected by heat evolved by the dielectric breakdown or by a reduction in bonding strength between the neighboring layers used in the EL panel. Accordingly, the fourth embodiment of the present invention shown in and described with reference to FIG. 8** is advantageous in that any possible reduction in quality of the display can be minimized.

Where the size of each picture element is large, no problem such as discussed above in connection with the deviation between the picture element at each of the transparent electrodes and the associated filter will occur and, therefore, arrangement may be made that filters **48*b* and 48*c* corresponding in function and structure to the filters 18*b* and 18*c* shown in FIG. 4 may be formed on a surface of the substrate 11 opposite to the surface thereof where the layers 12 to 17 are formed, as shown in FIG. 9** which shows a fifth preferred embodiment of the present invention.

Figure 10:
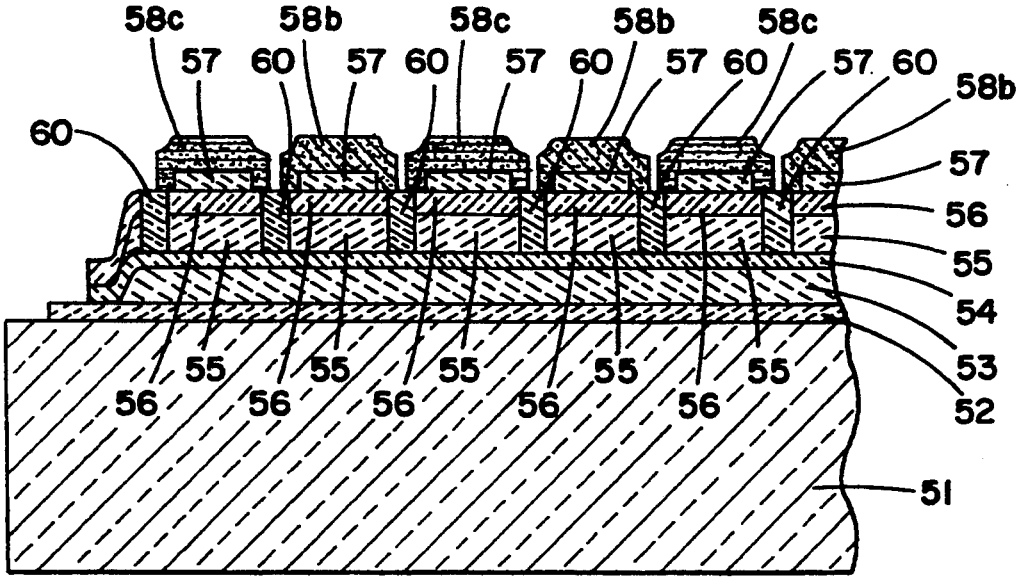
Figure 11:
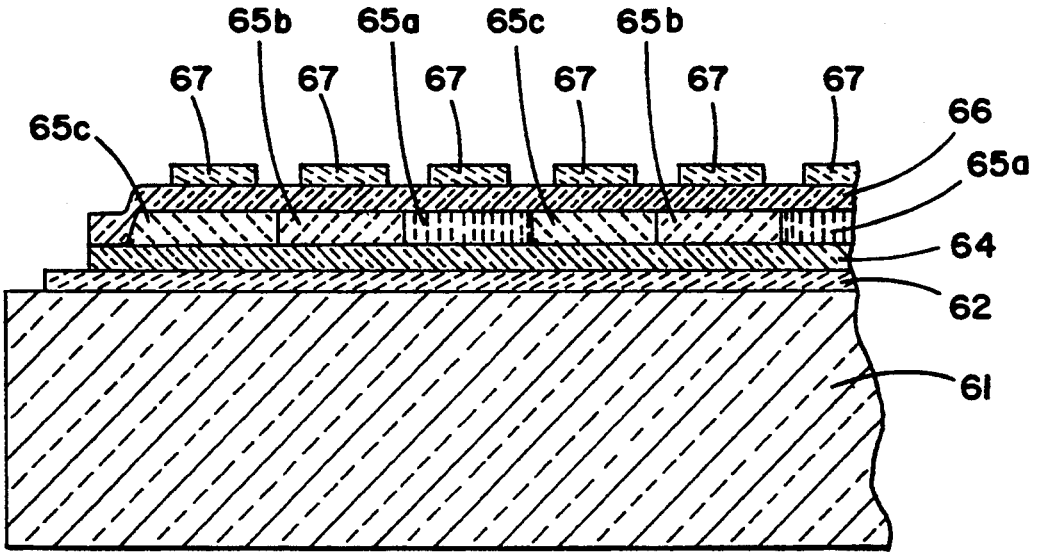
FIG. 11 (PRIOR ART)
FIGS. 11 and 12 are schematic sectional views showing the prior art multi-color EL panels.
Figure 12:
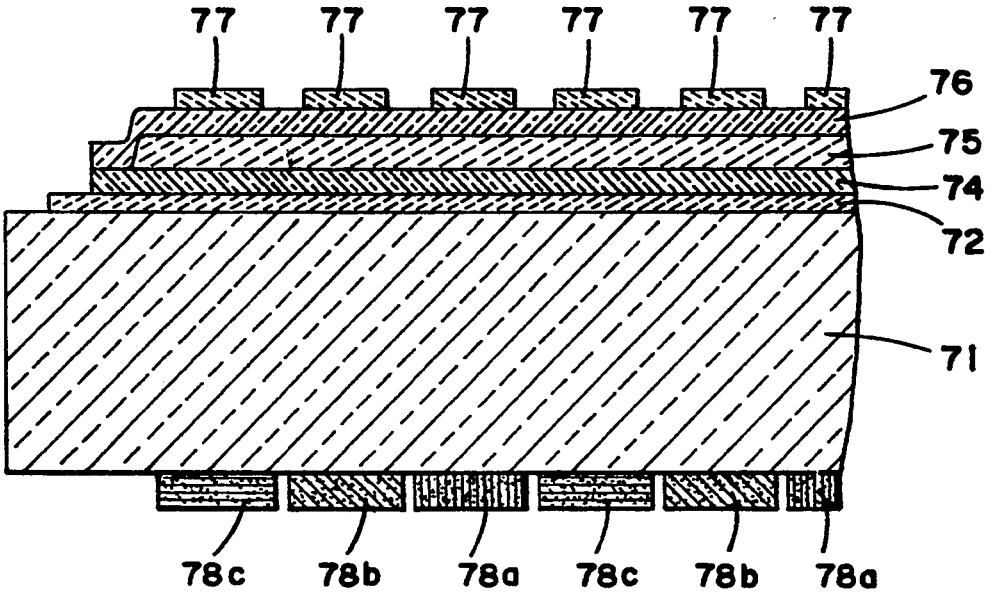
FIG. 12 (PRIOR ART)

The EL panel according to a sixth preferred embodiment of the present invention shown in FIG. 10 is fabricated in the following manner. A plurality of common electrodes 52, a photo-conductive layer 53, a first insulating layer 54, a light emitting layer 55 and a second insulating layer 56 are sequentially deposited on one surface of a glass substrate 51 in a manner similar to the arrangement shown in and described with reference to FIG. 4. Thereafter, by the use of an RIE (reactive ion etching) process, portions of any one of the second insulating layer and the light emitting layer 55 which are delimited between the neighboring members of the picture elements are removed so as to leave corresponding cavities. By the use of a sol-gel method, these cavities are subsequently filled up with $SiO_2$ 60 containing Ti micronized particles which serve as a light shielding material (or, by the use of a painting method, organic insulating material containing black pigments is filled in these cavities). Thereafter, as is the case with tile second preferred embodiment of the present invention, transparent electrodes 57 and filters **58*b* and 58*c* are formed cyclically, thereby completing the fabrication of the EL panel shown in FIG. 10**.

According to the sixth embodiment of the present invention wherein those portions of the light emitting layer 55 delimited between tile neighboring picture elements are removed to provide the cavities which are subsequently filled up with the light shielding material, there is no possibility that light from any one of the picture elements then emitting light may propagate within the light emitting layer of high refractive index. Accordingly, portions of the photo-conductive layer around the picture element or elements then emitting light would not represent a low resistance and, therefore, it is possible to prevent some of the picture elements which ought not to emit light from emitting light.

From the foregoing description, it is clear that the EL panel according to the present invention exhibits a hysteresis in light emission luminance versus applied voltage characteristic, and the band-pass color filter means for passing therethrough light of a particular color emitted from the EL light emitting layer. Accordingly, the EL panel according to the present invention is effective to provide a high luminance of practically acceptable level.

Also, where the EL panel employs the white light emitting layer for the light emitting layer, it is possible to provide any desired colors such as, for example, primary colors of blue, green and red.

In addition, where the photo-conductive layer is employed between the first and second electrodes, the resultant EL panel utilizes the hysteresis in light emission luminance versus applied voltage characteristic to provide a higher luminance.

Yet, where the EL panel is of a type wherein the photo-conductive layer is formed between the first and second electrodes and those portions of the light emitting layer delimited between the neighboring picture elements are removed, it is possible to prevent some of the picture elements which ought not to emit light from emitting light.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An electroluminescent panel, comprising:

first and second electrodes;

first and second insulating layers disposed between said first and second electrodes;

light emitting layer means, disposed between said first and second insulating layers for generating light as a function of a voltage applied by said first and second electrodes, said light emitting layer means having a plurality of cavities formed therein which limit propagation of the generated light within said light emitting means; and a photo-conductive layer disposed between said first electrode and said first insulating layer to give a hysteresis in light emission luminance versus applied voltage characteristic.

2. An electroluminescent panel, comprising:

first and second electrodes;

first and second insulating layers disposed between said first and second electrodes;

light emitting layer means, disposed between said first and second insulating layers for generating light as a function of a voltage applied by said first and second electrodes, said light emitting layer means having a plurality of cavities formed therein which limit propagation of the generated light within said light emitting means; and a photo-conductive layer disposed between said first electrode and said first insulating layer to give a hysteresis in light emission luminance versus applied voltage characteristic wherein the photo-conductive layer is $Si_xC_{1-x}$ where $0<x<1$ and wherein at least one of said cavities contains a light shielding material.

3. An electroluminescent panel, comprising:

a plurality of picture elements including a first and second picture element, each picture element comprising:

first and second electrodes;

a light emitting portion disposed between said first and second electrodes, wherein said light emitting portion generates light as a function of a voltage developed between said first and second electrodes; and a photoconductive layer disposed between said first electrode and said first insulating layer to give a hysteresis in light emission luminance versus applied voltage characteristic;

wherein the panel further comprises a light shielding material disposed between the light emitting portion of the first picture element and the light emitting portion of the second picture element.

* * * * *

UNITED STATES PATENT AND TRADEMARK OFFICE

CERTIFICATE OF CORRECTION

PATENT NO. : 5,346,776

DATED : September 13, 1994

INVENTOR(S) : Taniguchi et al.

It is certified that error appears in the above-indentified patent and that said Letters Patent is hereby corrected as shown below:

In column 1, line 65, "SIP" should read --SID--.

In column 2, line 49, "For" should read --for--.

In column 4, line 42, insert --to-- after the word "equal".

In column 5, line 24, "gelatine" should read --gelatin--.

In column 6, line 62, "tile" should read --the--.

In column 7, line 1, "tile" should read --the--.

UNITED STATES PATENT AND TRADEMARK OFFICE

CERTIFICATE OF CORRECTION

PATENT NO. : 5,346,776

DATED : September 13, 1994

INVENTOR(S) : Taniguchi et al.

It is certified that error appears in the above-indentified patent and that said Letters Patent is hereby corrected as shown below:

In column 8, claim 3, lines 37, 38, 39, 40, 41, delete "a light emitting portion disposed between said first and second electrodes, wherein said light emitting portion generates light as a function of a voltage developed between said first and second electrodes; and", insert --first and second insulating layers disposed between said first and second electrodes; a light emitting portion disposed between said first and second insulating layers wherein said light emitting portion generates light as a function of a voltage developed between said first and second electrodes; and--.

Signed and Sealed this

Thirtieth Day of September, 1997

*Attest:*

*Attesting Officer*

BRUCE LEHMAN

*Commissioner of Patents and Trademarks*